US010662594B1

(12) United States Patent
Lafoy

(10) Patent No.: US 10,662,594 B1
(45) Date of Patent: May 26, 2020

(54) BRIDGE REHABILITATION SYSTEM

(71) Applicant: Brian J. Lafoy, Plano, TX (US)

(72) Inventor: Brian J. Lafoy, Plano, TX (US)

( * ) Notice: Subject to any disclaimer, the term of this patent is extended or adjusted under 35 U.S.C. 154(b) by 0 days.

(21) Appl. No.: 15/717,348

(22) Filed: Sep. 27, 2017

Related U.S. Application Data

(60) Provisional application No. 62/400,245, filed on Sep. 27, 2016.

(51) Int. Cl.
*E01D 22/00* (2006.01)
*B66F 11/00* (2006.01)

(52) U.S. Cl.
CPC ..... *E01D 22/00* (2013.01); *B66F 11/00* (2013.01)

(58) Field of Classification Search
CPC ..... E01D 22/00; B66F 11/00
USPC ..... 14/77.1
See application file for complete search history.

(56) References Cited

U.S. PATENT DOCUMENTS 4,301,565 A * 11/1981 Weinbaum ..... E01D 22/00 14/77.1
4,320,548 A * 3/1982 Tada ..... E01D 21/065 14/73.5
5,363,527 A * 11/1994 Rainaud ..... E01D 15/127 14/2.4
2010/0175205 A1* 7/2010 Jorkama-Lopez .... E01D 19/106 14/77.1
2013/0081215 A1* 4/2013 Capolupo ..... E01D 21/00 14/77.1

* cited by examiner

*Primary Examiner* — Raymond W Addie
(74) *Attorney, Agent, or Firm* — Eldredge Law Firm

(57) ABSTRACT

A bridge support system includes a telescoping arm extending from a first end to a second end, the telescoping arm having a first arm section; a second arm section, the second arm section is configured to slidingly engage with the first arm section; a locking pin to secure the second arm section in a fixed position; a lower bearing assembly pivotally attached to the first end of the telescoping arm, the lower bearing assembly having a bearing plate pivotally attached to the first end of the telescoping arm via a pivot pin, the bearing plate is configured to engage with a ground surface; an upper bearing assembly pivotally attached to a jacking beam support, the upper bearing assembly having a plurality of holes for selective adjustment of the upper bearing assembly relative to the jacking beam support; and a jacking beam secured to the jacking beam support and secured to a bridge member.

1 Claim, 8 Drawing Sheets

BRIDGE REHABILITATION SYSTEM

BACKGROUND

1. Field of the Invention

The present invention relates generally to construction, and more specifically, to a system and method for supporting or lifting bridges during bridge rehabilitation.

2. Description of Related Art

Bridge rehabilitation systems and methods are well known in the art. In FIG. 1, a conventional bridge construction and replacement system 101 is shown. System 101 depicts a pair of abutments 105 and 109 with a pair of foundation piers 117, three cambered beams 119; deck elements 113 and 111, and parapet walls 103.

Bridges, like many structures, are susceptible to deterioration over time. Some bridge repairs, such a surface repaving, may be completed relatively quickly with minor inconveniences. However, large-scale bridge repairs, such as replacing or repairing an existing bridge component, often require raising the bridge off of existing support structures. While the bridge is raised, temporary bridge supports are needed to prevent failure during repair and to allow access to certain system components. Therefore, as with many other large-scale construction projects, great care must be taken in repairing and rehabilitating bridges due to their size, cost, weight, potential safety hazards, as well as the inconvenience created while the bridge is inaccessible during repairs.

Conventional methods of temporary bridge support during bridge rehabilitation involved showing towers, temporary construction structures, and/or cranes. While these methods offer temporary support during bridge rehabilitation, the installation of such large temporary structures generally requires a substantial amount of time and may result in extensive Lane closures and traffic congestion. Since many bridges can span across roads, highways, interstates, streams, and rivers passing underneath the bridge, the large structures used in conventional bridge-support methods are extremely hazardous as they are located very near, or possibly, on the roadways passing beneath the bridge as well as in the path of potential flood waters. Due to the hazardous nature of the conventional bridge support structures, the potential for traffic congestion and collision is also higher. Additionally, the temporary and potentially unstable nature of the support may cause more severe problems if cars or workers collide or otherwise disturb the bridge-support structures, potentially resulting in the catastrophic failure. Accordingly, a long-felt need has existed for a high strength, temporary bridge support systems that does not affect the flow of traffic passing over and under the bridge or over floodwaters during bridge rehabilitation.

Although great strides have been made in the bridge support systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
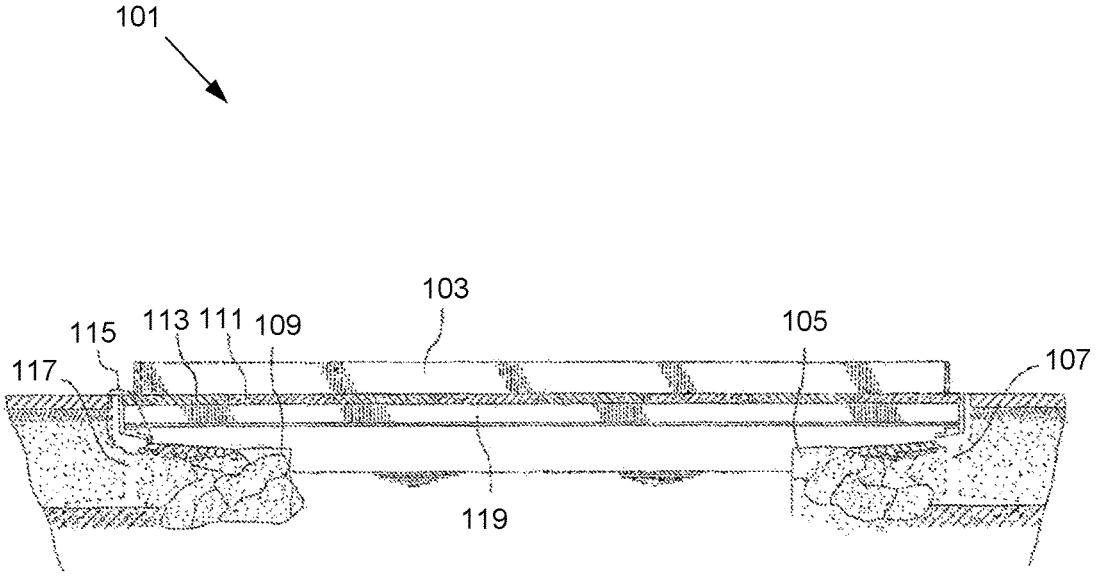
FIG. 1 PRIOR ART
FIG. 1 is a front view of a conventional bridge support system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with bridge-support systems. Specifically, the system of the present application provides an efficient, economic, and easily installable method of bridge support during bridge rehabilitation which minimizes or eliminates traffic disruption.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
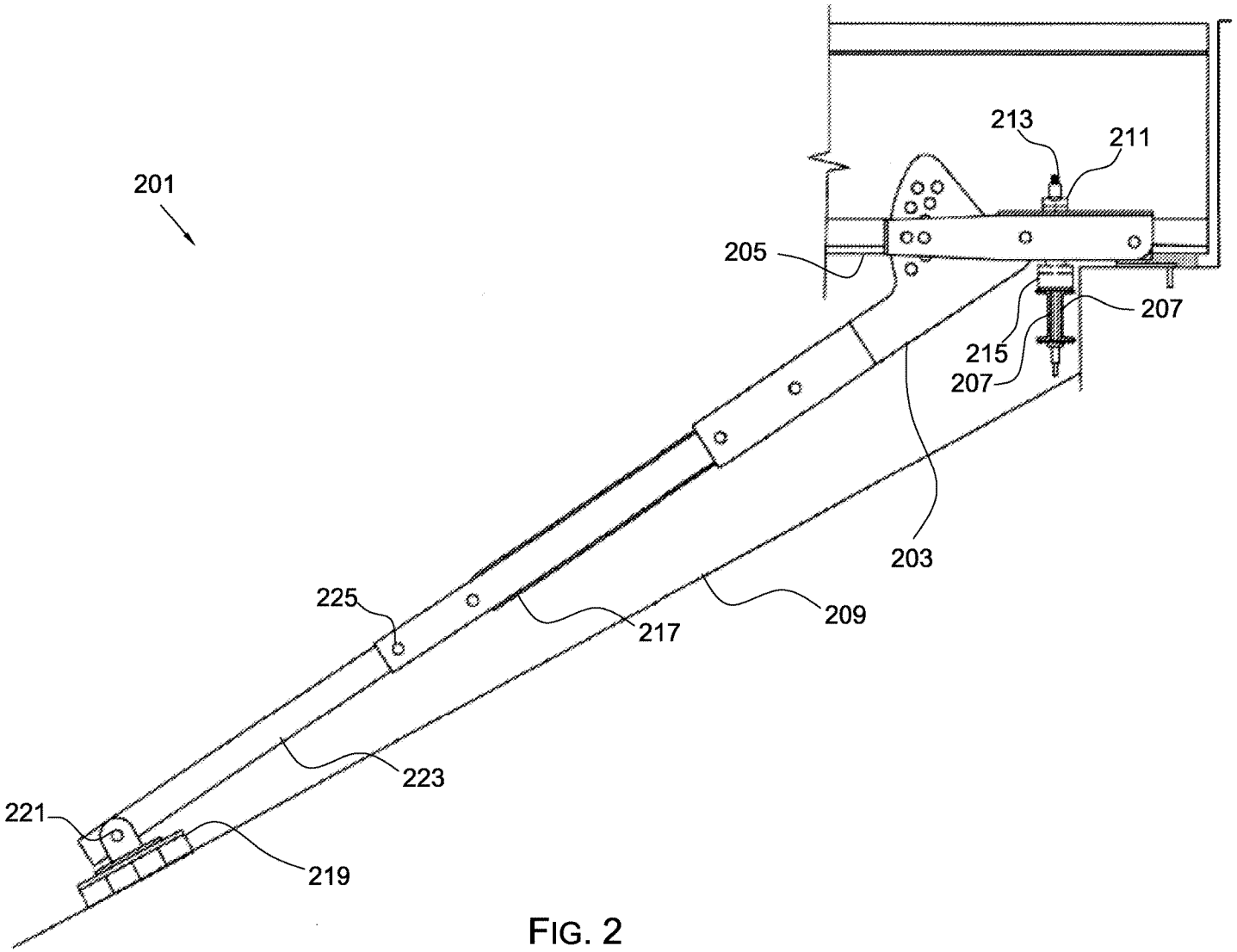
FIG. 2 is a side view of a bridge support system in accordance with a preferred embodiment of the present application.

Referring now to the drawings wherein like reference characters identify corresponding or similar elements throughout the several views, FIG. 2 depicts a bridge support system in accordance with a preferred embodiment of the present application. It will be appreciated that the bridge support system 201 overcomes one or more of the above-listed problems commonly associated with conventional bridge support systems.

Figure 3:
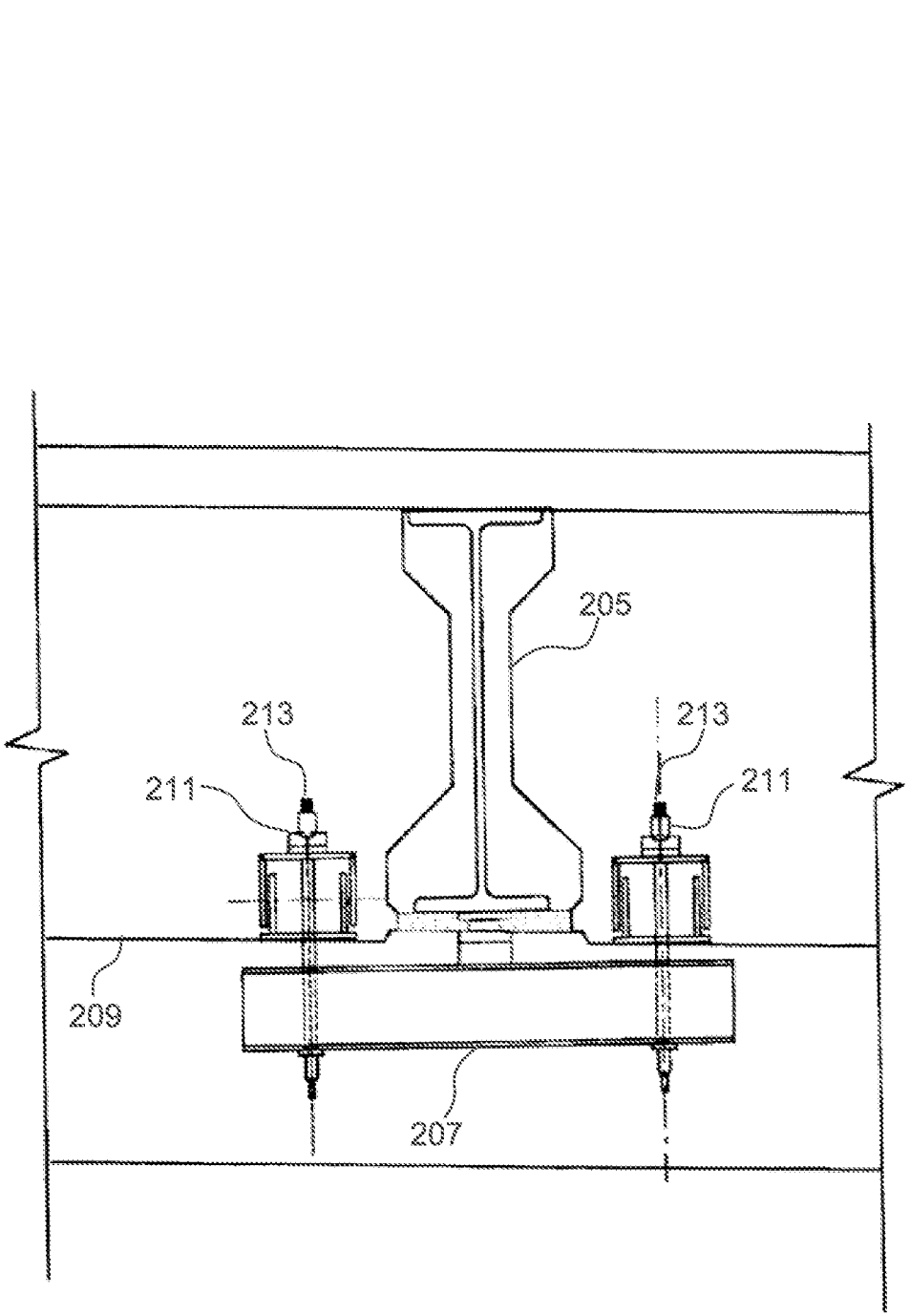
FIG. 3 is a front view of the bridge support system of FIG. 2.
Figure 4:
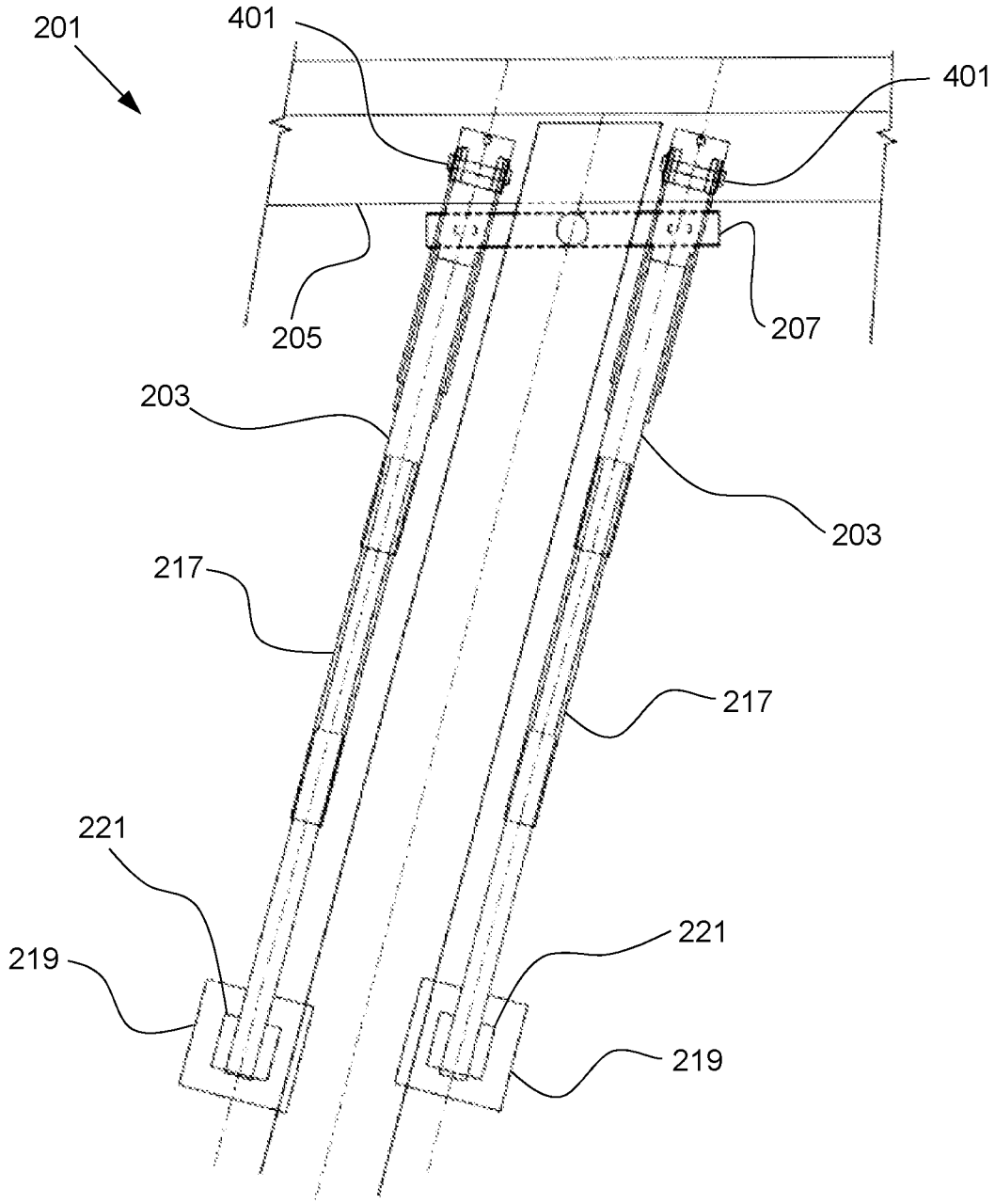
FIG. 4 is a top view of the bridge support system of FIG. 2.

FIGS. 2, 3, and 4 depict the bridge-jacking abutment lever assembly of the bridge-support system 201 configured to provide support at bridge abutments while also accommodating for the abutment slope 209. The bridge jacking abutment lever assembly dissipates the load at the lower bearing assembly 219 and 221 as the load is transmitted from the upper bearing assembly to the lower bearing assembly through the telescoping arm assembly. The upper bearing assembly may be positioned above a bridge abutment cap and may further be temporarily fastened to the concrete to prevent movement.

The upper bearing assembly 203 may feature pre-cut holes for which high-strength threaded rods 213 may pass through. The high-strength threaded rods 213 may connect the upper bearing assembly to a jacking beam 207 or low-profile jacking beam (discussed in further detail herein) located on the side of the bridge abutment cap, from which the bridge beam 205 may be lifted. The upper bearing assembly 203 may be further connected to an adjustment assembly which allows for adjustment based on the slope 209 of the bridge abutment. The adjustment assembly may be comprised of a high-strength material and may feature multiple holes through which high-strength pins 225 may be inserted to lock the adjustment assembly in place once the bridge-jacking abutment lever assembly is adjusted to the desired abutment slope angle. The adjustment assembly may be further connected to the telescopic arm assembly, which may be comprised of telescopic sections 217 and 223 of high-strength material. In the present embodiment, the telescopic sections 217 and 223 may feature holes at various points along the side of the sections through which high-strength pins 225 may be inserted to allow for variations in lengths of the telescopic arms 217 and 223 depending on the load transferred and the space available. The telescopic arms 217 and 223 may be used to transmit the load to the lower bearing assembly, which is comprised of a high-strength plate attached to the telescopic arm assembly with a rocker pin 221 to allow for adjustment of the plate depending on the bridge abutment slope angle 209.

Figure 5:
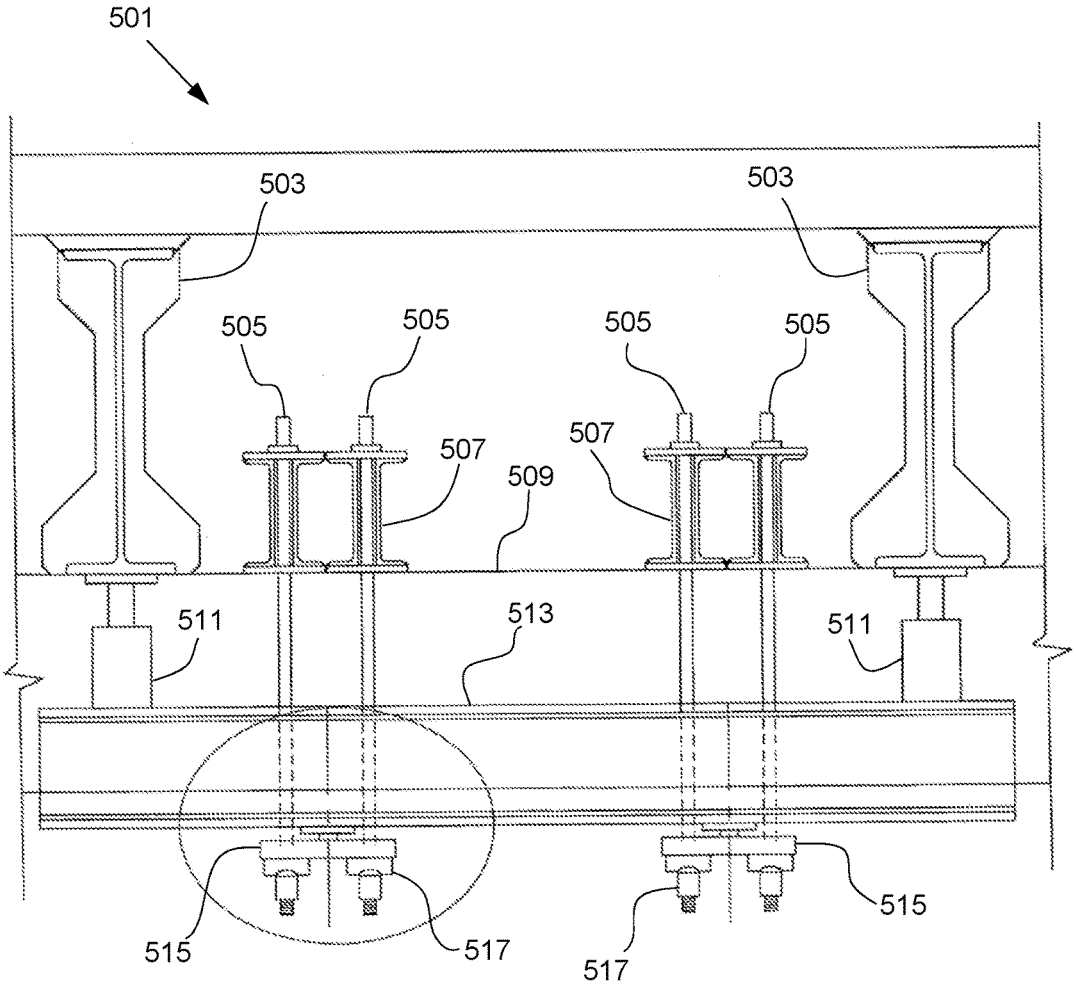
FIG. 5 is a front view of a bridge support system in accordance with an alternate embodiments of the present application.
Figure 6:
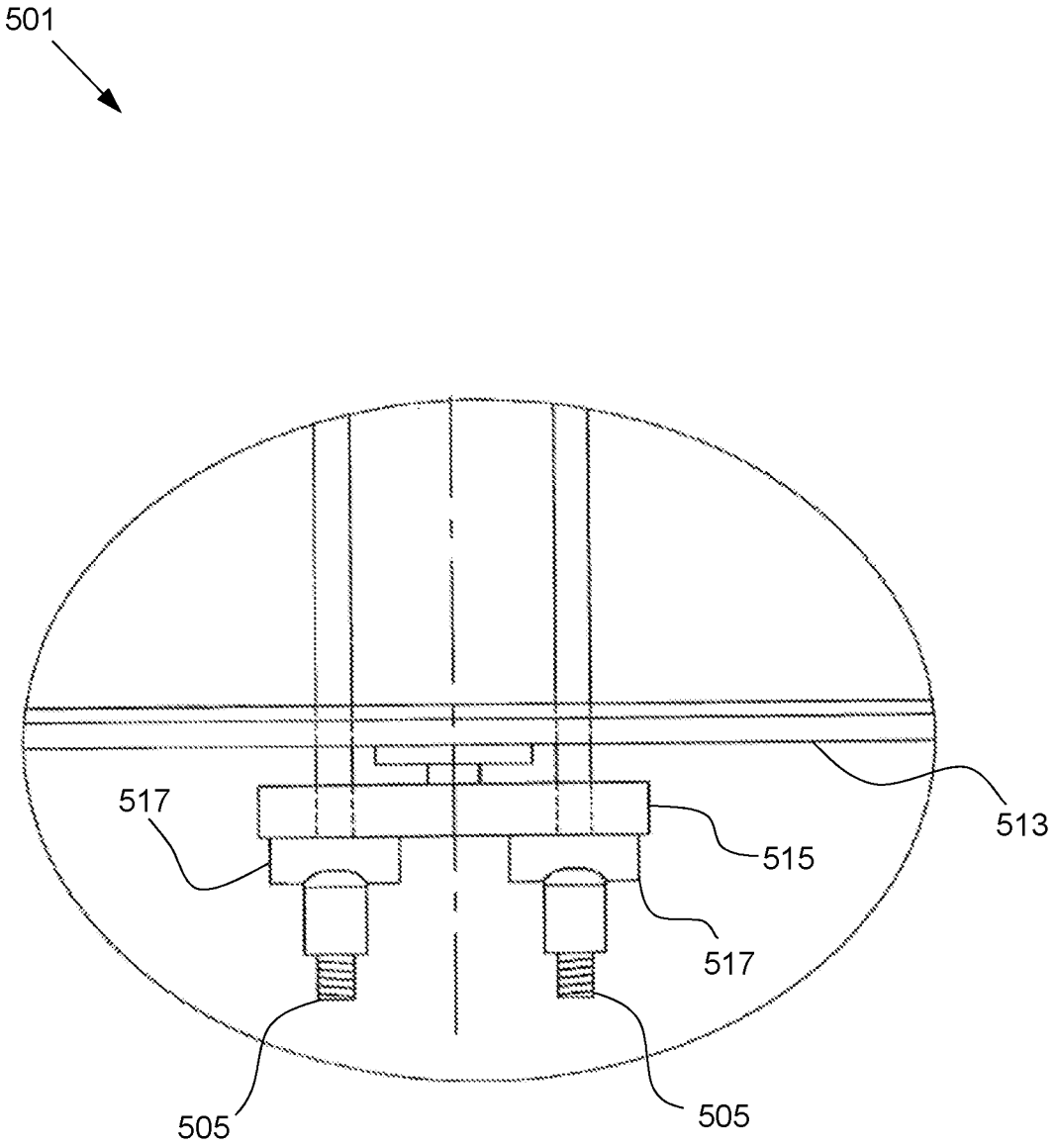
FIG. 6 is a partial front view of the bridge support system of FIG. 5.

Referring now to FIGS. 5 and 6, a front views of system 501 are respectively shown in accordance with an alternative embodiment of the present application. System 501 is substantially similar in function to system 201 and it is contemplated interchanging the features of the different types of the systems discussed herein.

In an alternative embodiment, system 501 is a jacking assembly referred to as a double-rod rocker assembly. Unlike conventional methods of temporary bridge support, the jacking assembly of the present invention may be positioned around a bridge bent cap and below the bridge deck surface, negating any negative effect on the flow of traffic. The jacking assembly in the present embodiment may be comprised of specialty beams aligned perpendicularly. One set of the beams may be jacking beams 507, located on either side of the bridge bent cap in a parallel orientation to each other. The jacking beams 507 may be used as the constructive base from which beams may be raised using hydraulic jacks 511 since hydraulic jacks 511 may be placed on top of the jacking beams directly below the bridge beams to be raised. The jacking beams may be connected to another set of beams through a high-strength threaded rod assembly. The second set of beams may be saddle beams 513, located above a bridge bent cap in a parallel orientation to each other and oriented perpendicularly to the jacking beams 507. When the bridge is raised, the load may be transferred through the hydraulic jacks 511 and jacking assembly 501 and into the existing bridge bent cap. Depending on the amount of load to be lifted, the jacking assembly 501 may be used to lift one beam or multiple beams at one time.

System 501 concentrates the jacking load to a single point on the jacking beam. In this embodiment, the jacking assembly may be configured similarly to the configuration as shown in FIG. 2, except with additional saddle beams 513 and a double-rod rocker assembly. Additional saddle beams 513 may be useful when attempting to support heavier loads. The additional saddle beams 513 may be located above the bridge bent cap and may be further connected to the jacking beams 507 through additional high-strength threaded rods 505. To avoid eccentric loading on the multiple rods 505, which could potentially cause collapse of the jacking assembly 513 and 511, the multiple rods 505 may be secured to the jacking beams 507 through a double-rod rocker assembly 515 and 517 which focuses the applied loads from multiple rods 505 to a single point at the jacking beam-saddle beam connection points. The double-rod rocker assembly 515 and 517 may facilitate symmetric loading, thereby negating potential loading difficulties during bridge-raising.

Referring now to FIGS. 5 and 6, front views of the double-rod rocker assembly is depicted. In this embodiment, one or more jacking beams 507 may be a back-to-back standard channel section that is plated top and bottom with a gap maintained between the channel sections for which the high-strength threaded rods 505 may pass through. The jacking beams 507 may be comprised of a high-strength material and may be fused together by means of welding or some other high-strength connection means. The top and bottom of the jacking beam 507 may feature pre-cut holes for which the high-strength threaded rods 505 may pass through.

In the present embodiment, the pre-cut holes provide multiple channels for which the high-strength threaded rods 505 may pass through, further allowing for longitudinal adjustment of the location of the high-strength threaded rods 505 to accommodate for various bearing locations and bridge column widths.

Figure 7:
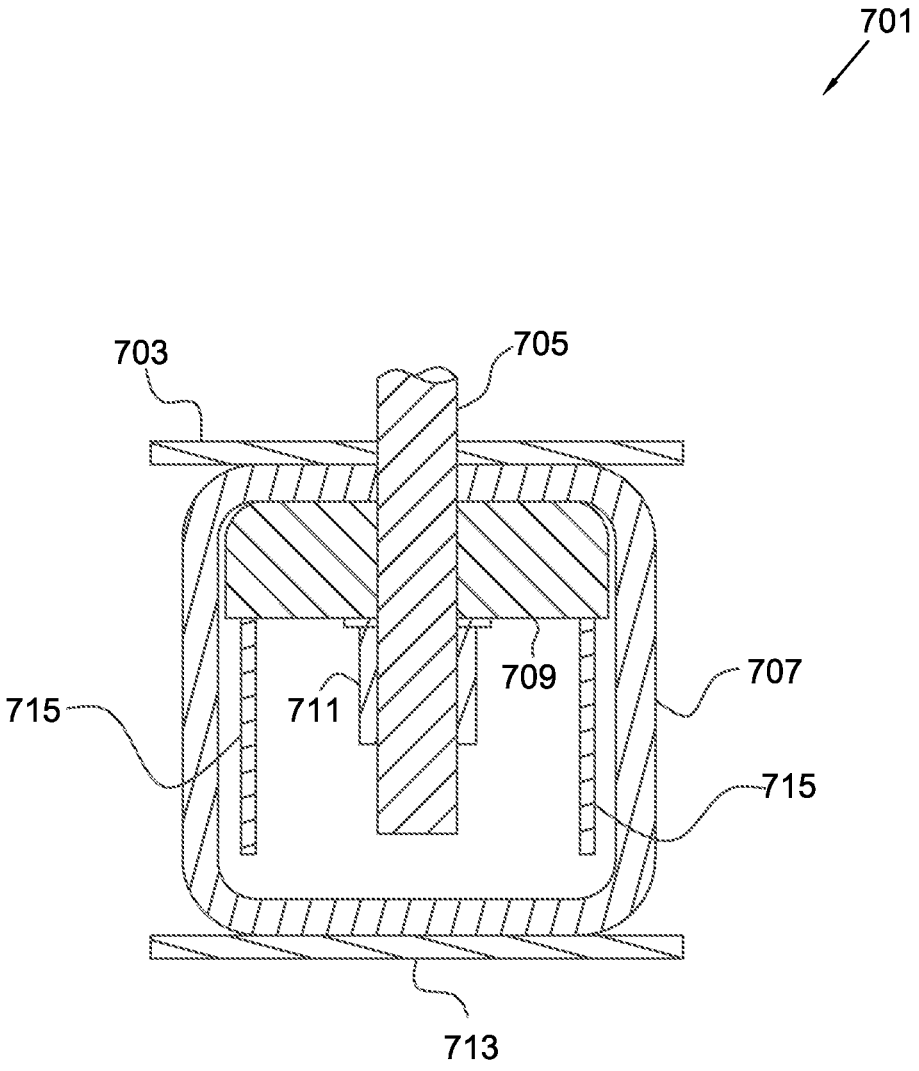
FIG. 7 is a front, section view of a bridge support system in accordance with an alternate embodiments of the present application.
Figure 8:
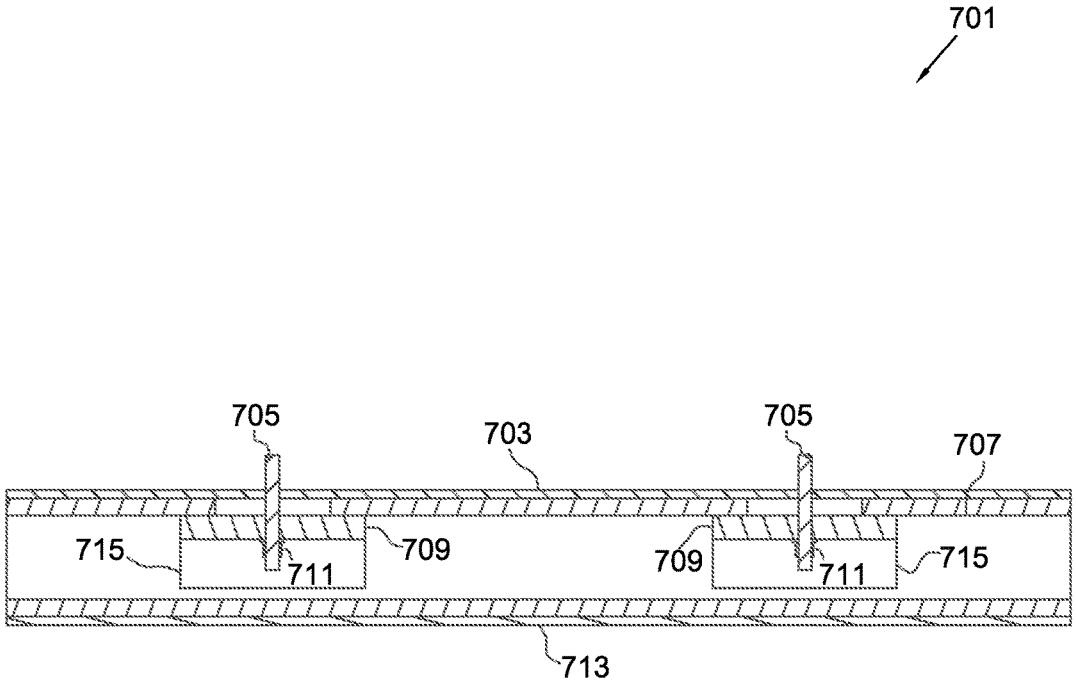
FIG. 8 is a side, section view of the bridge support system of FIG. 7.

Referring now to FIGS. 7 and 8, a section views of system 701 are respectively shown in accordance with an alternative embodiment of the present application. System 701 is substantially similar in function to systems 201 and 501 and it is contemplated interchanging the features of the different types of the systems discussed herein.

In an alternative embodiment, system 701 is referred to as a low profile bridge jacking beam. The low-profile jacking beam system 701 may be useful in situations where there is limited clearance under the bridge in which to provide support. System 701 includes one or more top and bottom plates 703 and 713, respectively, which are fixably attached to one or more structural tube members 707. The structural tube member 707 is depicted in FIGS. 7 and 8 as a square structural tube; however, it is appreciated that the shape of the tube 707 could be configured from many different shapes. One or more stiffener plates 709 is fixably attached inside the structural tube 707 with one or more vertical stiffener plate 715. The jacking shaft 705 extends through system 701 and is supported by shaft support 711. The top and bottom plates, 703 and 713, as well as the stiffener plate 709 may contain pre-cut holes for which the internal lifting and adjustment assembly may pass through.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bridge support system, comprising:

a telescoping arm extending from a first end to a second end, the telescoping arm having:

a first arm section;

a second arm section, the second arm section is configured to slidingly engage with the first arm section;

a locking pin to secure the second arm section in a fixed position;

a lower bearing assembly pivotally attached to the first end of the telescoping arm, the lower bearing assembly having:

a bearing plate pivotally attached to the first end of the telescoping arm via a pivot pin, the bearing plate is configured to engage with a ground surface;

an upper bearing assembly pivotally attached to a jacking beam support, the upper bearing assembly having a plurality of holes for selective adjustment of the upper bearing assembly relative to the jacking beam support; and a jacking beam secured to the jacking beam support and secured to a bridge member;

wherein the jacking beam is configured to raise the bridge relative to the ground surface.

* * * * *